US005749643A

United States Patent [19]

Porter et al.

[11] Patent Number: 5,749,643

[45] Date of Patent: May 12, 1998

[54] STEP LIGHT WITH DIFFUSER

[75] Inventors: David H. Porter, Chagrin Falls; Libbe A. Milicia, North Royalton, both of Ohio

[73] Assignee: The L.D. Kichler Co., Cleveland, Ohio

[21] Appl. No.: 820,644

[22] Filed: Mar. 14, 1997

[51] Int. Cl.[6] ..... F21S 1/02

[52] U.S. Cl. ..... 362/146; 362/223; 362/145

[58] Field of Search ..... 362/145, 146, 362/225, 290, 291, 292, 342, 298, 301

[56] References Cited

U.S. PATENT DOCUMENTS

| | | | |
|---|---|---|---|
| 934,122 | 9/1909 | Woodman | 362/146 |
| 2,756,323 | 7/1956 | Tusly | 362/146 |
| 4,143,411 | 3/1979 | Roberts | 362/146 |
| 4,425,601 | 1/1984 | Donahue | 362/146 |
| 5,430,627 | 7/1995 | Nagano | 362/146 |

*Primary Examiner*—Thomas M. Sember
*Attorney, Agent, or Firm*—Watts, Hoffmann, Fisher & Heinke, Co., L.P.A.

[57] ABSTRACT

Apparatus for lighting a lower tread of a stairway having the lower tread relatively parallel to and spaced a gap from an upper tread. The lighting apparatus includes illuminating means. A housing is positioned underneath the upper tread. The housing includes an open front face generally perpendicular to and facing a front portion of the lower tread. The housing defines an interior region adapted to contain the illuminating means and includes a wall having an opening sized to receive therethrough the illuminating means. The lighting apparatus includes a louver angularly overhanging the open front face of the housing so that light diffused from the illuminating means is directed downwardly to illuminate the lower tread. The louver includes a tab removably insertable into a pocket partially defined by a surface of the upper tread and a generally plane wall of the housing. The tab secures the louver in the overhanging position after the tab is installed in the pocket.

3 Claims, 2 Drawing Sheets

STEP LIGHT WITH DIFFUSER

FIELD OF THE INVENTION

The present invention concerns an apparatus for diffusing light to a tread of a stairway.

BACKGROUND OF THE INVENTION

Stairs that are insufficiently lit or that are subject to shadows exhibit a safety and security concern, especially outdoors where the light oftentimes can not be reflected towards its desired area of use. Illuminating the steps of a stairway, porch or deck however, can create undesired difficulties. For example, if the light source is located behind a subject as the subject approaches the steps, the subject may interfere with the path of illumination and cast a shadow that makes the steps difficult to see.

Light fixtures physically mounted to the stairs may also impose a danger because stray light or glare emitted from the fixtures may temporarily adversely affect a person's sight or line of vision of the stairs. Furthermore, light fixtures placed around the stairs may be subject to inadvertent damage, for example, by bumping with oblong objects or the like.

DISCLOSURE OF THE INVENTION

The present invention provides an improved lighting apparatus for illuminating a tread of a stair. The stair defines a gap spaced between the tread to be lit, or the lower tread, and a generally parallel upper tread. The lighting apparatus includes a housing that is positioned underneath the upper tread. The housing includes an open front face that is generally perpendicular to and facing a front portion of the lower tread. The housing defines an interior region adapted to contain illuminating means. A wall of the housing includes an opening that is sized to receive the illuminating means therethrough. A louver angularly overhangs the open front face of the housing so that light diffused from the illuminating means is directed downwardly at the lower tread.

According to the invention, the housing is connected to and extends downwardly from the upper tread. The illuminating means includes a lamp secured by a lamp socket and electrically connected to an electrical wire to provide power to the lamp. The electrical wire, extends through the opening in the housing.

The louver includes tabs that are inserted into a pocket that is partially defined by a surface of the upper tread and a generally plane wall of the housing. The tabs secure the louver in the overhanging position and allow the louver to be easily inserted and removed for quick access to the interior of the housing. The louver provides illumination of the lower tread without interfering with a subject's line of vision as the subject approaches the stair. The louver also substantially prevents inadvertent damage to the illuminating means.

BEST MODE FOR PRACTICING THE INVENTION

Figure 1:
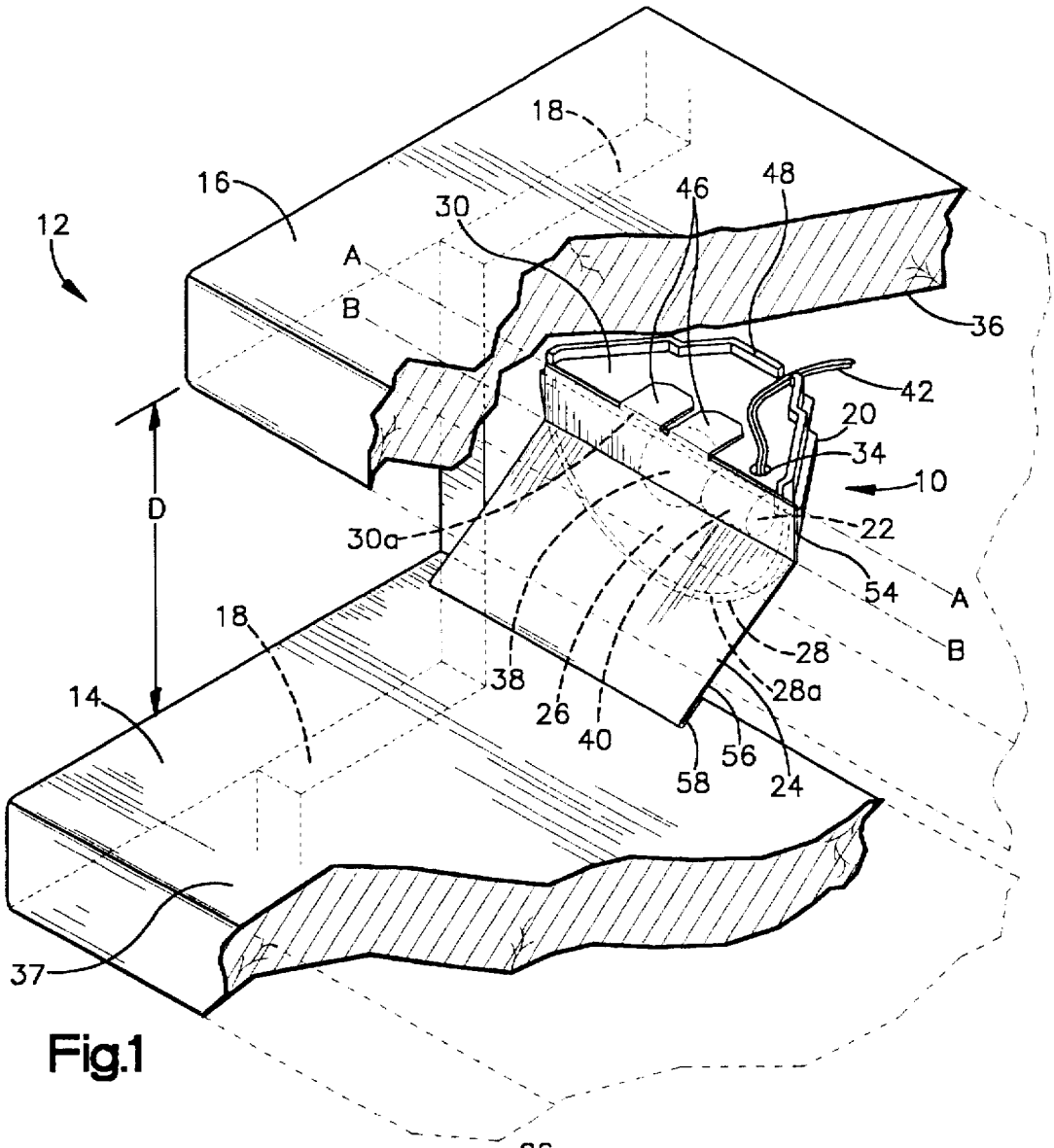
FIG. 1 is a broken perspective view of a stair showing a lighting apparatus constructed in accordance with the present invention installed underneath an upper tread of the stair.
Figure 2:
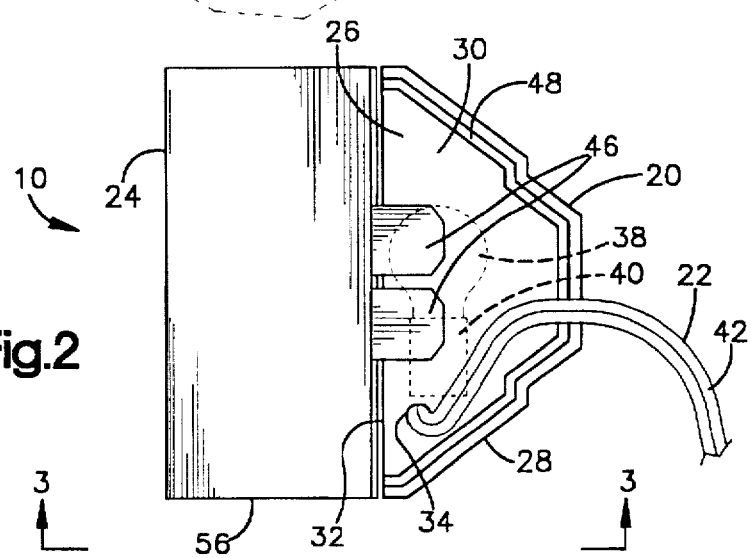
FIG. 2 is a plan view of the FIG. 1 lighting apparatus.

Referring now to the drawings, FIGS. 1–4 illustrate a lighting apparatus 10 constructed in accordance with the present invention. FIG. 1 shows the lighting apparatus 10 installed in a step, generally indicated by the reference character 12. The step 12 includes a lower tread 14 and an upper tread 16 that are relatively parallel to each other and spaced apart by a gap D. The treads 14, 16 are supported by walls 18.

The lighting apparatus 10 includes a housing 20, illuminating means 22 and a flexible louver 24. The housing 20 is made of a thermoplastic resin and defines an interior region 26 adapted to contain the illuminating means 22. The housing 20 includes a generally semi-circular cone-shaped wall 28 and a plane wall 30 connected at their common edges. The edges 28*a*, 30*a* of the respective walls 28, 30 form an open front face 32 generally perpendicular to the plane wall 30. As shown in FIG. 1 of the invention, the plane wall 30 defines an opening 34 through which the illuminating means 22 are inserted. The plane wall 30 of the housing 20 is connected to a surface 36 underneath the upper tread 16 by suitable fastening means so that the semi-circular cone-shaped wall 28 extends downwardly and the open front face 32 of the housing 20 faces a front edge 37 of the lower tread 14.

The illuminating means 22 includes a lamp 38 secured by a lamp socket 40. An electrical cable 42 extends through the plane wall 30 via the opening 34 for providing power to the lamp 38.

Figure 3:
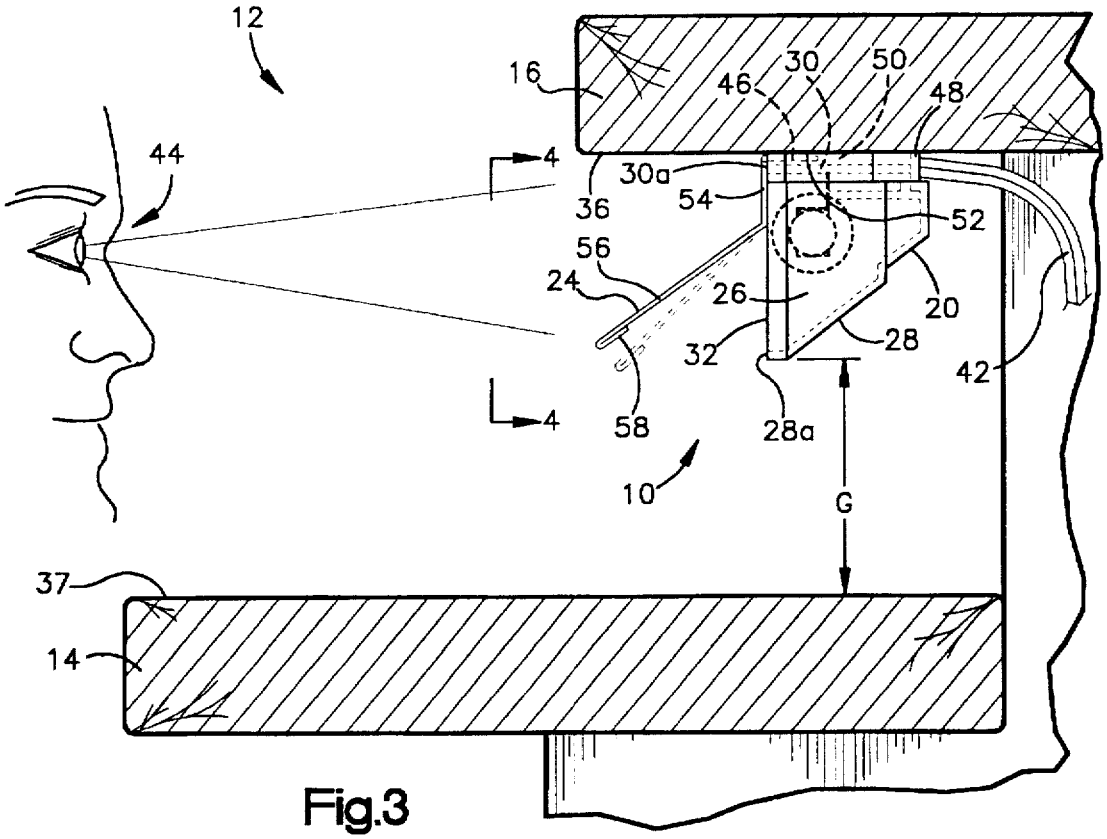
FIG. 3 is a side elevation view of the FIG. 2 lighting apparatus as seen from the plane 3—3 in FIG. 2 showing the apparatus installed underneath the upper tread and further showing an angularly overhanging louver.
Figure 4:
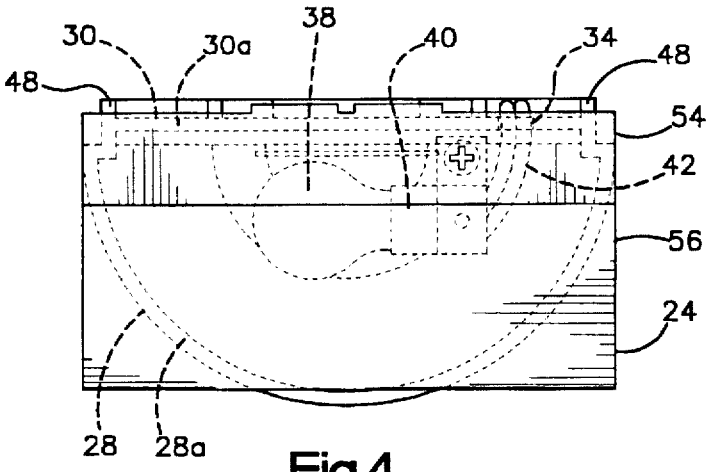
FIG. 4 is a partial front side elevation view of the FIG. 3 lighting apparatus as seen from the plane 4—4 in FIG. 3 showing a pocket to receive tabs from the louver.

The flexible louver 24 is made of stamped sheet metal that is bent into the configuration shown in FIGS. 1 and 3. The louver 24 angularly overhangs the front face 32 of the housing 20. As shown in FIG. 3, the housing 20 and louver 24 are spaced a gap G from the lower tread 14 so that light emitted from the open front face 32 of the housing 20 diffuses downwardly at the lower tread 14. According to the invention, the lighting apparatus 10 illuminates the lower tread 14 without emitting glare into the eyes of a subject (indicated generally by the reference character 44) approaching the step 12. Consequently, a brighter, or more luminous lamp can be used to light the step 12.

The louver 24 includes tabs 46 that secure the louver 24 in its overhanging position. As shown in FIGS. 1 and 3, the housing 20 includes a rib 48 extending from the plane wall 30 so that the plane wall 30 and the surface 36 of the upper tread 16 form a pocket 50 into which the tabs 46 are inserted. The weight of the louver 24 imposes a counterclockwise moment in the louver 24 about an axis A—A so that the tabs 46 frictionally engage a region 52 of the surface 36 of the upper tread 16. This frictional engagement of surface 36 retains the louver 24 in its overhanging position after the tabs 46 have been inserted into the pocket 50.

The louver 24 also includes a riser member 54 and an angle member 56. The riser member 54 is connected to the tabs 46 at its upper end and to the angle member 56 at its lower end. The riser member 54 extends downwardly from tread 16 and adjacently to the front face 32 of the housing 20. The riser member 54 partially frictionally engages edges 28*a*, 30*a* of the front face 32, thereby improving stability of the louver 24 with respect to the housing 20 and maintaining the louver 24 in the desired angular overhanging position. As shown in FIG. 1, the amount of light emitted from the open front face 32 of the housing 20 at the lower tread 14 can be adjusted by bending the angle member 56 about an axis B—B to its desired angular orientation.

The louver 24 is easily removable to gain access to the interior region 26. By exerting an upward force on the louver 24 sufficient to disengage the tabs 46 from surface 36, the tabs 46 can be slid out from the pocket 50. The louver 24 includes a lip 58 that stiffens the edge of the louver 24. The louver 24 is sufficiently flexible so that in the event the louver 24 is inadvertently bumped the louver 24 flexes (shown in phantom in FIG. 3), and then returns to an unflexed configuration.

While the present invention has been described with a degree of particularity, it is the intent that the invention include all alterations and modifications from the disclosed design falling within the spirit or the scope of the appended claims.

We claim:

1. A step light, comprising: a housing including an upper wall portion adapted to be secured to the underside of a step and a front face that forms a light emitting opening, a lamp in said housing for emitting light through said opening, and a louver overhanging said opening, said louver extending downwardly from said upper housing wall and away from said front face in order to direct light downward onto the tread of a step below said housing.

2. A step light as claimed in claim 1 including means for holding said louver against said housing adjacent said light emitting opening.

3. A step light as claimed in claim 2 wherein said means for holding said louver comprises louver portions engaged between said upper wall portion and the step to which said housing is secured.

* * * * *